US008833277B2

(12) United States Patent
Magaldi et al.

(10) Patent No.: US 8,833,277 B2
(45) Date of Patent: Sep. 16, 2014

(54) COOLING SYSTEM FOR DRY EXTRACTION OF HEAVY BOTTOM ASH FOR FURNACES DURING THE STORING STEP AT THE HOPPER

(75) Inventors: Mario Magaldi, Salerno (IT); Rocco Sorrenti, Salerno (IT)

(73) Assignee: Magaldi Power S.p.A., Salerno (IT)

( * ) Notice: Subject to any disclaimer, the term of this patent is extended or adjusted under 35 U.S.C. 154(b) by 1216 days.

(21) Appl. No.: 12/227,585

(22) PCT Filed: May 21, 2007

(86) PCT No.: PCT/EP2007/004646

§ 371 (c)(1), (2), (4) Date: Aug. 6, 2009

(87) PCT Pub. No.: WO2007/134874

PCT Pub. Date: Nov. 29, 2007

(65) Prior Publication Data

US 2010/0064950 A1 Mar. 18, 2010

(30) Foreign Application Priority Data

May 23, 2006 (IT) ..... MI2006A1010

(51) Int. Cl.
*F23J 1/02* (2006.01)
*F23J 1/06* (2006.01)

(52) U.S. Cl.
USPC ..... 110/259; 110/165 R

(58) Field of Classification Search
CPC ..... F23J 1/00–1/02; F23J 2700/001; F23J 2700/003; F23L 2900/05041
USPC ..... 110/165 R, 166, 171, 259, 344
See application file for complete search history.

(56) References Cited

U.S. PATENT DOCUMENTS

| | | | | |
|---|---|---|---|---|
| 4,336,131 | A * | 6/1982 | Schmidt et al. | 209/3 |
| 4,774,908 | A * | 10/1988 | Liszewski et al. | 110/165 R |
| 5,775,237 | A * | 7/1998 | Reilly et al. | 110/234 |
| 7,311,049 | B2 * | 12/2007 | Magaldi | 110/171 |
| 7,559,725 | B2 * | 7/2009 | Mathis et al. | 406/168 |

FOREIGN PATENT DOCUMENTS

| | | | | |
|---|---|---|---|---|
| WO | WO 3085323 A1 * | 10/2003 | | F23J 1/02 |

* cited by examiner

*Primary Examiner* — Kenneth Rinehart
*Assistant Examiner* — David J Laux
(74) *Attorney, Agent, or Firm* — Olson & Cepuritis, Ltd.

(57) ABSTRACT

The present invention relates to a cooling system for dry extraction of heavy bottom ash output from furnaces for solid fuel during storing step at hopper, characterized by suitable air intakes (2), placed on the sidewalls of the hopper (1) at the hopper bottom, through which a controlled amount of cooling air passes sucked up in the combustion chamber (12) by the depression value therein, capable to achieve an uniform and balanced distribution system for such air during storing step at hopper (1) which optimizes the cooling of the falling ash, leaving the total amount of the air entering the furnace unchanged. The distribution header of the intakes (2) is connected to the extractor environment (6) by the lid (7) through a suitable conduit (3) provided with automated valve (8) being open during the storing step allowing the cooling air through to pass said intakes (2) placed on the sidewalls of the hopper (1). A more efficient cooling may be obtained by any addition of water input by nozzles (14) suitably placed within the hopper (1). The water amount may be adjusted such that the ash cooling improvement function is actuated without humidifying it.

4 Claims, 5 Drawing Sheets

COOLING SYSTEM FOR DRY EXTRACTION OF HEAVY BOTTOM ASH FOR FURNACES DURING THE STORING STEP AT THE HOPPER

In the dry ash extraction systems (see European Patent EP 0 471 055 B1) the cooling of the ash on the extractor conveyor and on the subsequent conveyors is achieved by the thermal exchange by forced convection with air returning inside the system sucked up by the depression value being at the furnace bottom. The cooling air returns through suitable intakes placed on the sidewalls of the extractor and the subsequent conveyors and runs over the ash counter-flow passing through the line of the transport machines till it reaches the combustion chamber. The operating mode of the known extraction system provides the power to close the valves at the furnace bottom and store the ash within the hopper. This operation allows an optimum flexibility of the system permitting to carry out the maintenance operations. During the storing step at the hopper, the ash begins to settle on the bottom valves and first, when the ash height is not high yet, the cooling air can pass into the hopper cooling both the ash just settled, passing through the material bed, and the free falling ash, crossing it in counter-flow. While the ash height increases above the bottom valves, the air incurs higher and higher drag on entering the hopper, the air amount is smaller and smaller till it fully humbles itself. In this case, no outer intervention allows for the cooling of the ash being stored and as the outstanding hopper capability, the ash amount at high temperature discharging onto the extractor during the opening of the bottom valves is such that it cannot be cooled by the system counter-flow air and this causes forward wearing problems and malfunctions due to local deformations particularly on the milling members downstream of the extractor.

Even when the storing duration is short, the air distribution in the hopper is not constant because of the not uniform ash storing profile in the hopper either for front combustion furnaces or for tangential combustion furnaces, thus there can be not very cooled zones because of the air difficulty in crossing the formed ash bed.

Further, in case of dry extractors that have slopes higher than natural declivity angle of the material conveyed there may be ash storing at the curve section. In this case the section between the conveyor belt and lid is occupied by the material, obstructing the passage and constraining the cooling air to pass the zone below the belt. Thin ash, which is stored under the conveyor belt so causing malfunctions in the thin ash recovery system, is dragged together with the air.

Those problems are fully solved by means of the system according to the present invention which provides a suitable number of cooling air intakes placed on the sidewalls of the storing hopper on the upper part at the ash maximum height. Such side intakes may be connected to each other by only one pipe connected to the extractor and dimensioned such that an uniform distribution of the cooling air over the hopper walls can be obtained. On the pipe connecting the hopper to the extractor a valve is mounted which is opened when the cooling of the ash is to be assured also during the storing step.

At the storing step, with the bottom valve closed, the cooling air entering the system through admissions on the extractor sidewalls cross this path alternative in respect of the path the air keeps during operation in normal mode.

If needed, the cooling effect from the entering air is enhanced by addition of water through nozzles placed either on the hopper sidewalls or in the hopper air intakes. The position of the air intakes and nozzles is such that free entry of air is assured even in case of ash stored up to the maximum height expected. The resulting steam returns the furnace sucked up by the depression being therein and helps for a further cooling crossing the counter-flow falling ash. The water amount to be sent to the nozzles is finely adjusted based on ash temperature and flow rate values shown by suitable sensors, such that it helps suitably the cooling without humidifying it.

The innovative features, objects and advantages of the present invention will become clear from the following description and the annexed drawings regarding forms of not limiting embodiments in which various figures show:

About that it would be desirable to specify that like referral numbers in different figures indicate equal or similar elements.

Figure 1:
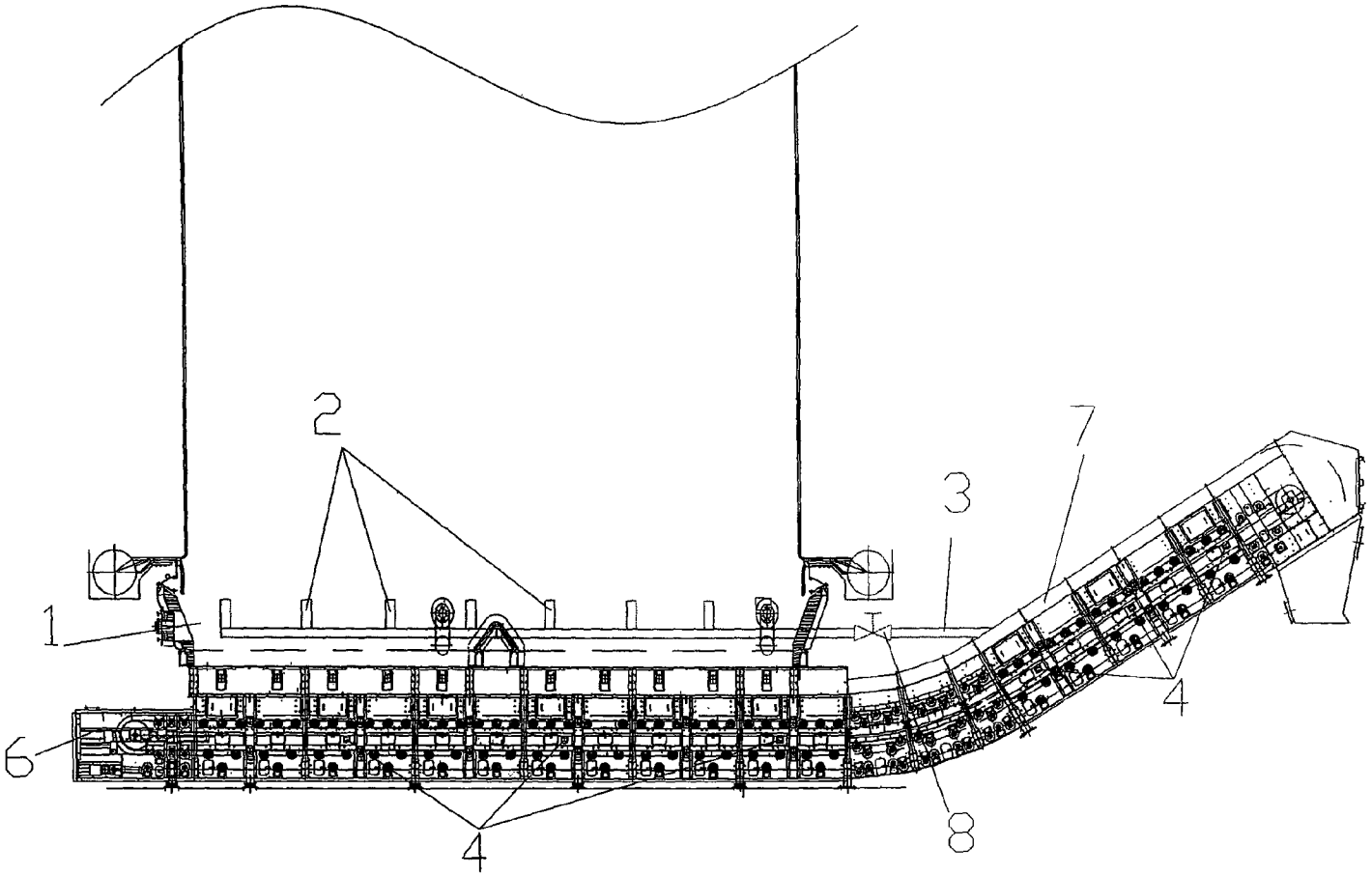
FIG. 1 is side view of the ash extractor provided with air intakes on the sidewall of the storing hopper connected by means of valve to the extractor environment.
Figure 2:
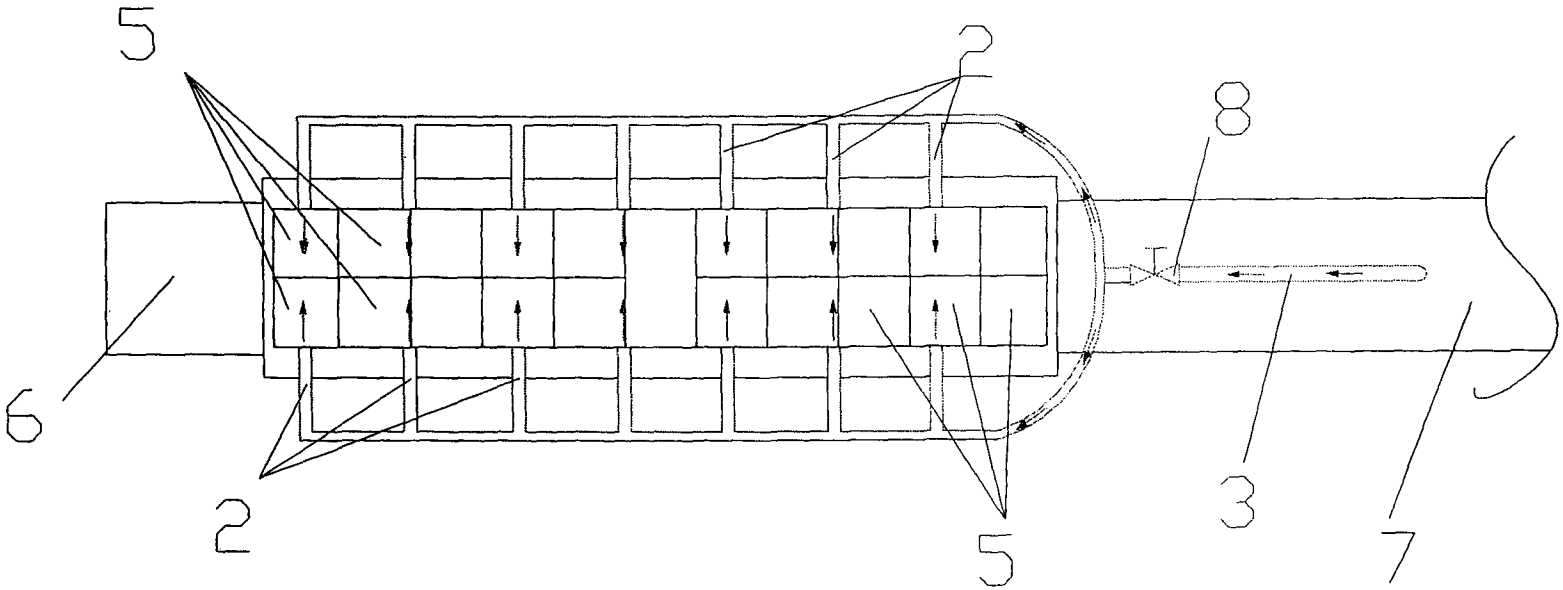
FIG. 2 is a top view of the intakes at the storing hopper and of the connection to the extractor environment.
Figure 3:
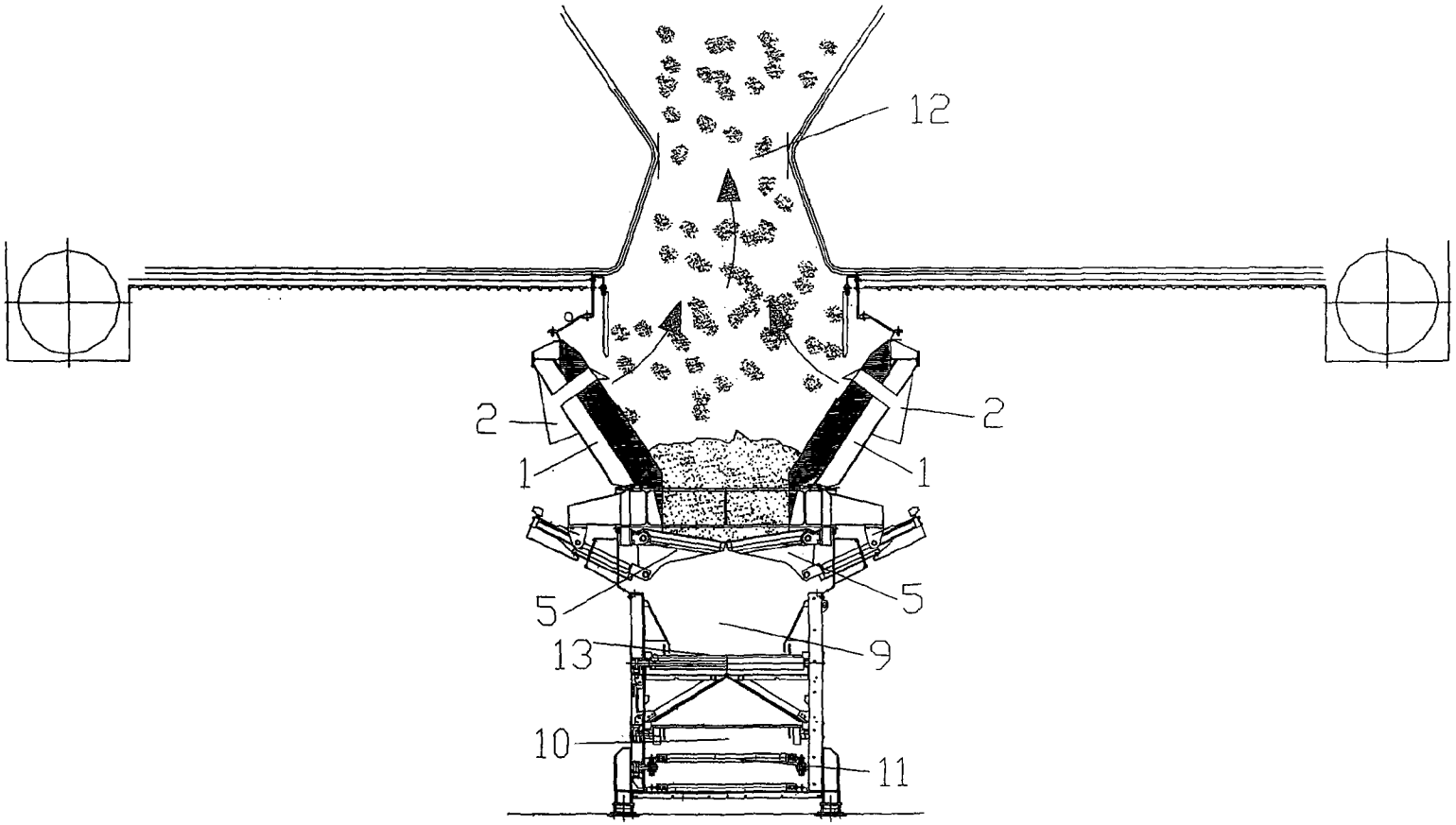
FIG. 3 is a cross-sectional view of the extractor at the storing hopper pointing out the presence of the cooling water supply nozzles.
Figure 4:
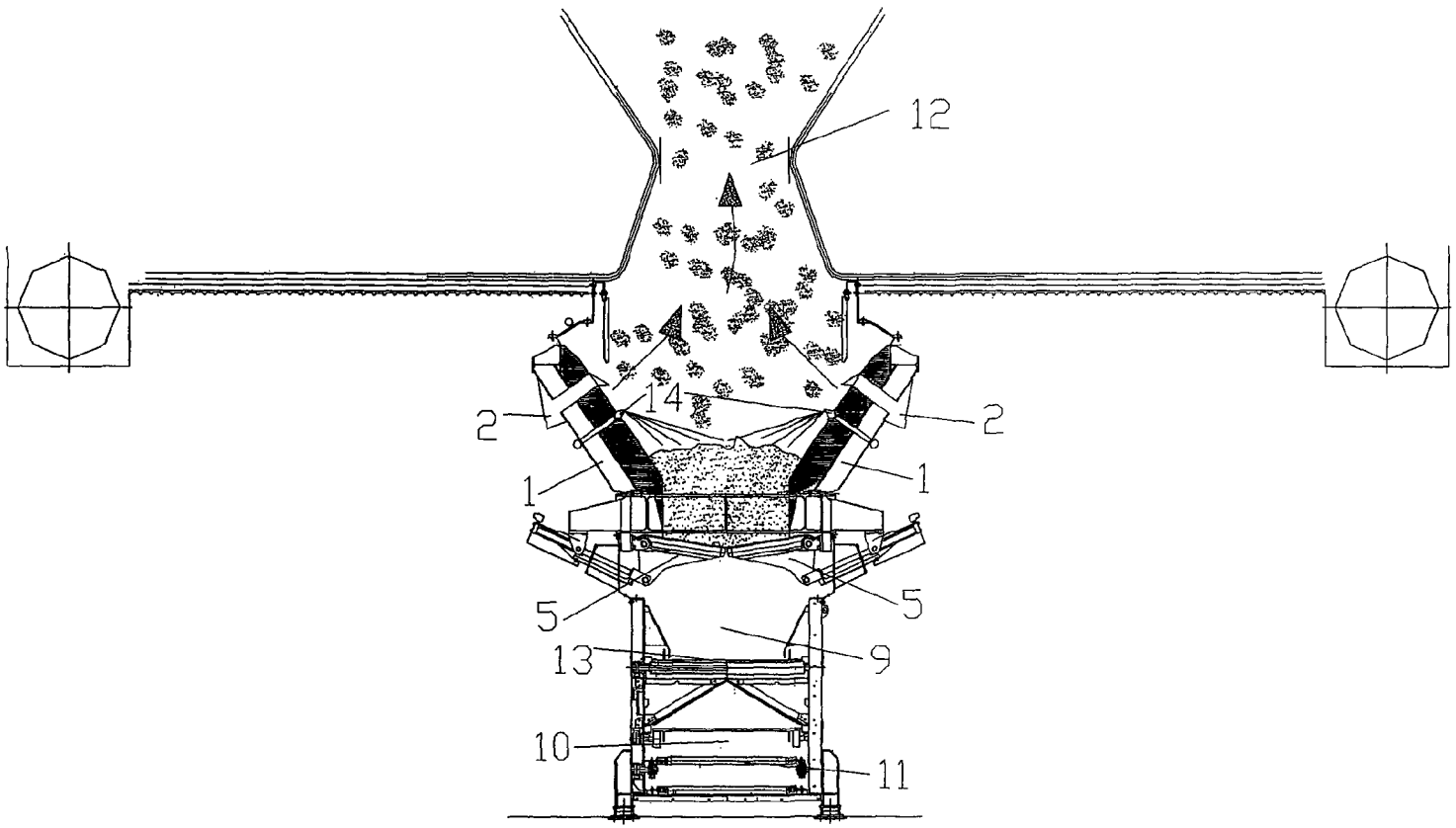
FIG. 4 is a cross-sectional view of the extractor similar to FIG. 3 but showing injection of cooling water through nozzles in the storing hopper.
Figure 5:
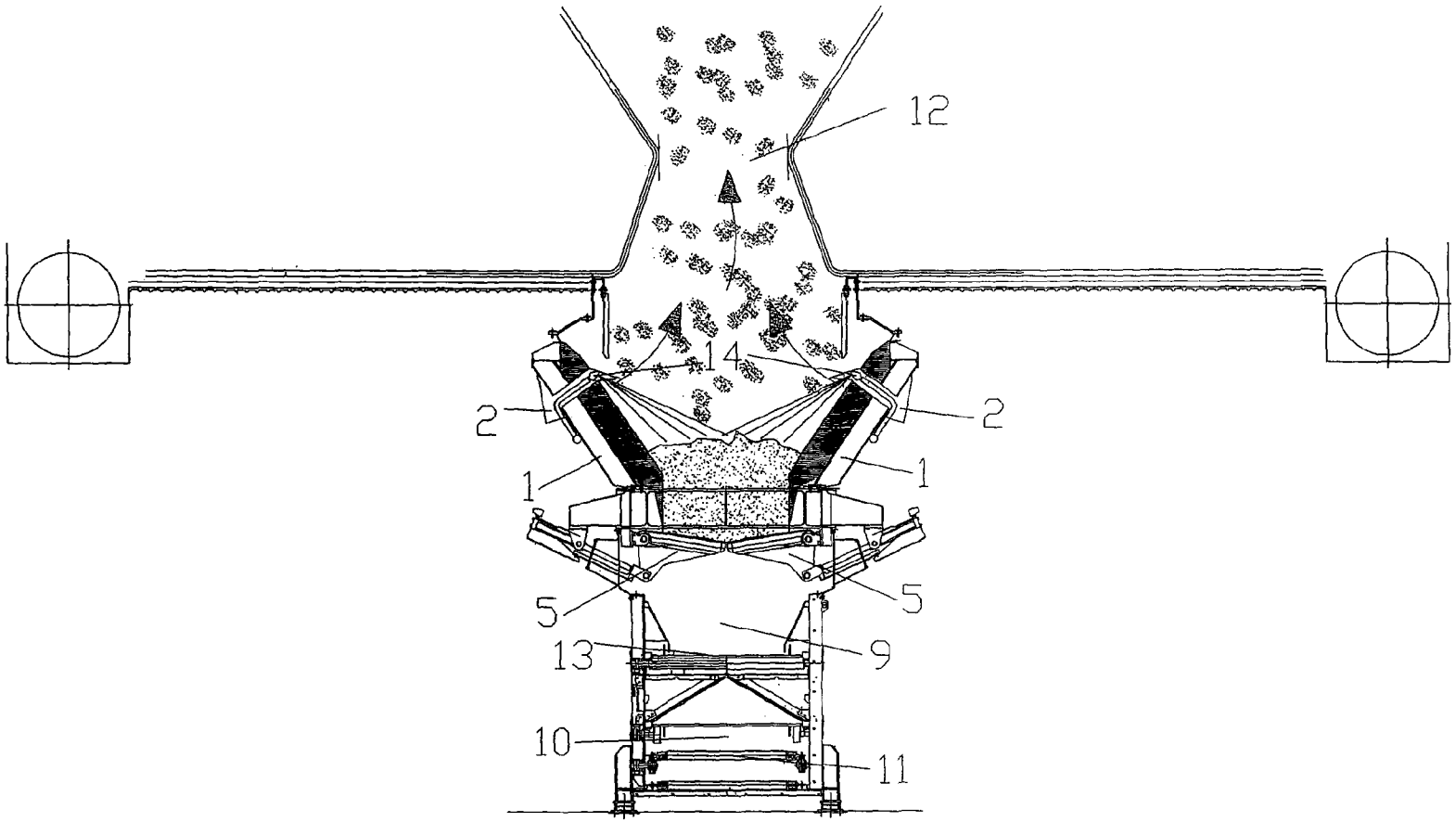
FIG. 5 is a cross-sectional view of the extractor at the storing hopper pointing out the presence of the cooling water supply nozzles placed into the side entries.

The ash cooling system, subject-matter of the present invention, allows, during the ash storing step at the hopper (1), for cooling ash while falling through the relief of the furnace (12) by means of a system with side entries (2). Since the air distributing chute (3) is connected directly to the extractor (6), the air entry from the environment occurs through the same side intakes (4) used during the normal operation step. Thus, the air amount used for the cooling is always the same during either continuous operation or storing step.

The extra air intakes (2) are placed on the sidewall of the hopper (1) at height being over the maximum height of the ash storable onto the bottom valves (5), such that obstructions and malfunctions of the intakes (2) due to the great ash height can be avoided. Such air intakes (2) are supplied for each side of the hopper (1) by a single chute (3) connected to the lid (7) of the extractor (6) by means of either manual or automatic valve (8). Thus, when the storing step at the hopper (1) starts with the bottom valves (5) closed, by opening the valve (8) the cooling air is sucked up from outside through the side entries (4) due to the combustion chamber depression.

Opening of the valve (8) is operated simply by closing of the bottom valves (5). After closing the bottom valves (5) the air sucked from outside through the side intakes (4) enters the extractor (6), and not being able to enter the furnace since the bottom valves (5) are closed, is constrained to go toward the chute (3). The bottom valves (5) are not airtight, as a result a certain amount of the air will keep passing through the bottom, till the stored ash layer onto the valves (5) closes fully the passage.

The use of the ash cooling system during the storing step is useful also in plant configurations that provide an extractor slope greater than natural declivity angle of the conveyed material. In such a case, during the extraction step at curve, some ash stores may occur in connection with landslides of the material on the leaning stretch.

When this occurs, the passage area (9) included between the conveyor belt (13) and the lid (7) is fully obstructed and then the cooling air is constrained to pass over the lower conveying part. Since the cooling air is full of thin ash, this settles on the bottom of the recovery system (11), thus obstructing it. If alternatively the valve (8) is opened the air can by-pass the upper part avoiding obstruction of the recovery system (11).

This mode of air inflow into the furnace has outstanding advantages relative to the cooling of the stored ash due to a more uniform air distribution over the whole passage surface of the falling ash, with no need to increase the amount of air entering the furnace.

A further configuration of the cooling system at the hopper provides use of cooling water (14) through nozzles suitably placed inside the hopper which helps in cooling the ash stored on the bottom valves (5), running over it after having been finely dosed in order to cool but not to humidify the ash. The water amount supplied to the nozzles is, indeed, adjusted based on the temperature and flow rate values of the stored ash, measured by suitable sensors (not shown) placed inside the hopper. The steam output during the water cooling is sucked up by the depression at the furnace and is mixed with the combustion smoke and thus adds further cooling of the ash falling from the combustion chamber. Such a further expedient results as an important contribution for the ash cooling process since it takes advantage of the water latent heat of vaporization which subtracts heat from the ash stored at the hopper, but leaving dry the ash recovered from the hopper bottom by the known extraction system.

The invention claimed is:

1. A cooling system for heavy ash formed in furnaces for fossil fuel, during a storing step in a hopper (1) therefor at furnace bottom, which cooling system comprises: the hopper (1) having air intakes (2) placed on its sidewalls; an extractor conveyor belt (6) of the ash which extractor conveyor belt is situated downstream from the hopper (1) and has a metallic container with a lid (7), the lid having one or more side air intakes (4) by which a controlled cooling air amount enters from the environment and is sucked up by a depression in a furnace combustion chamber; and an air distribution chute (3) configured to connect the lid (7) of the extractor conveyor belt (6) with the hopper air intakes (2), wherein the system is configured that, during the storing step at the hopper, outside air entering the extractor conveyor belt (6) through the air intakes (4) is constrained to go in the air distribution chute (3) and through the hopper air intakes (2).

2. The cooling system according to claim 1, characterized in that cooling of the ash in the hopper (1) is enhanced by addition of water supplied into the hopper (1) in a quantity such as to cool the ash without humidifying it.

3. The cooling system according to claim 2, characterized by cooling water nozzles (14) placed either on the sidewalls of the hopper (1) or in the air intakes (2) into the hopper.

4. The cooling system according to claim 3, characterized by stored ash flow rate and temperature sensors installed inside the hopper (1) that finely dose an amount of water supplied to the nozzles (14), and steam output produced by the cooling process having been sucked up in the furnace combustion chamber along with combustion smoke.

* * * * *